US006255546B1

(12) United States Patent
Alexander

(10) Patent No.: US 6,255,546 B1
(45) Date of Patent: Jul. 3, 2001

(54) FUNCTIONAL FLUID WITH LOW BROOKFIELD VISCOSITY

(75) Inventor: Albert Gordon Alexander, Sarnia (CA)

(73) Assignee: ExxonMobile Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/499,727

(22) Filed: Feb. 8, 2000

(51) Int. Cl.[7] ..... C10M 169/00

(52) U.S. Cl. ..... 585/1; 585/7; 585/302; 508/110

(58) Field of Search ..... 585/1, 7, 302; 508/110

(56) References Cited

U.S. PATENT DOCUMENTS

| | | | | |
|---|---|---|---|---|
| 5,208,403 | * | 5/1993 | Buchanan et al. | 585/7 |
| 5,578,236 | * | 11/1996 | Srinivasan et al. | 508/188 |
| 5,635,459 | * | 6/1997 | Stoffa et al. | 508/186 |
| 5,641,732 | | 6/1997 | Bloch et al. | 508/232 |
| 5,641,733 | | 6/1997 | Bloch et al. | 508/232 |
| 5,646,099 | | 7/1997 | Watts et al. | 508/232 |
| 5,750,477 | * | 5/1998 | Samiejski et al. | 508/331 |

FOREIGN PATENT DOCUMENTS

| | | | |
|---|---|---|---|
| WO9936491 | 7/1999 | (WO) | C10M/133/36 |

* cited by examiner

*Primary Examiner*—Jacqueline V. Howard
(74) *Attorney, Agent, or Firm*—Joseph J. Allocca

(57) ABSTRACT

A functional fluid of low Brookfield Viscosity comprising a mixture of hydrocracked base stocks, optionally a minor amount of solvent neutral base stock, and additives.

9 Claims, No Drawings

FUNCTIONAL FLUID WITH LOW BROOKFIELD VISCOSITY

BACKGROUND OF THE INVENTION

1. Field of the Invention

The invention relates to functional fluids having low Brookfield Viscosities comprising a mixture of base stocks and containing performance additives.

2. Description of the Related Art

Functional fluids comprise a broad range of lubricants that are used in automotive and industrial hydraulic systems, automotive transmissions, power steering systems, shock absorber fluids, and the like. These fluids transmit and control power in mechanical systems, and thus must have carefully controlled viscometric characteristics. In addition, these fluids may sometimes be formulated to provide multigrade performance so as to ensure year round operation in variable climates. Among the most important requirements for a functional fluid is low temperature fluidity, which can be measured by, for example, the Brookfield viscometer.

Automatic transmission fluids are one of the most common functional fluids, and an integral part of all automatic transmissions. Automatic transmissions are used in about 80% to 90% of all vehicles in North America and Japan and their use is becoming more commonplace in other parts of the world. They are the most complex and costly subassemblies of a vehicle and the major OEMs have stringent specifications to control all aspects of the components that go into their manufacture.

An automatic transmission comprises a torque converter, planetary gears, output drives and hydraulic system. The ATF acts as a hydraulic fluid to transfer power in the torque converter and to actuate complex controls to engage the gears to give the correct vehicle speed. The fluid must have the right viscometrics at ambient start-up temperatures, while maintaining sufficient viscosity at higher operating temperatures. ATF must also be very oxidation stable because it is subjected to high temperatures and is expected to remain in service for up to 100,000 miles in some cases.

Whereas in the past automatic transmission fluids generally used solvent neutral base stocks, and their use is still common in some applications, over the past few years, with the increasing performance demands being made on automatic transmission fluids, the use of hydrocracked base stocks have become more widespread. These base stocks tend to give improved low temperature performance and longer oxidation life.

It has now been found that particular blends of hydrocracked base stocks, which may also contain some minor amount of solvent neutral base stocks, give excellent low temperature Brookfield performance.

DESCRIPTION OF THE INVENTION

The present invention is directed to a functional fluid comprising:

(A) a mixture of at least two hydrocracked base stocks, said mixture comprising (i) at least one first hydrocracked base having a kinematic viscosity of about 3.5 to about 6.5 $mm^2$/sec at 100° C., a viscosity index of about 100 to about 120, a pour point of about −12° C. maximum, an aniline point of about 100° C. to about 120° C., a saturates content of about 92 to about 99 mass %;

(ii) at least one second hydrocracked base stock having a kinematic viscosity of about 1.5 to about 3.5 $mm^2$/sec at 100° C., a viscosity index of about 90 or higher, a pour point of about −30° C. maximum, an aniline point of about 95° C. to about 110° C., a saturates content of about 90 to about 99 mass %;

said first and second hydrocracked base stocks being mixed in an amount of about 60 to about 90 vol % of the first hydrocracked base stock (i) and about 10 to about 40 vol % of the second hydrocracked base stock (ii), based on hydrocracked stock;

wherein the first hydrocracked base stock (i) and second hydrocracked base stock (ii) are not the same; and (B) zero up to about 45 vol % of one or more conventional solvent neutral base stock(s), the conventional solvent neutral base stock(s) having a kinematic viscosity of about 2.5 to about 5.5 $mm^2$/sec at 100° C., a viscosity index of about 90 to about 105, a pour point of about −12° C. maximum, an aniline point of about 95° C. to about 105° C., a saturates content of about 75 to about 85 mass %; wherein said mixture of base stocks has a kinematic viscosity of about 3.7 to about 5 $mm^2$/sec at 100° C., a viscosity index of about 100 to about 115, a pour point of about −24° C. maximum;

(C) an additive package, the resulting additized functional fluid having, a kinematic viscosity of about 6.8 to about 8.0 $mm^2$/sec at 100° C., a viscosity index of about 150 to about 200, a pour point of about <−42° C. maximum, and a Brookfield viscosity of about 15,000 cP or less at −40° C.

The hydrocracked base stocks may be prepared by use of any of the hydrocracking process procedures currently used in the art, as well as any processes yet to be developed. It is believed the performance and function of the hydrocracked base stocks in the present invention are independent of the particular procedural techniques employed in the production of the base stocks. Typically hydrocracked base stocks are made starting with distillate from the atmosphere/vacuum pipestills and/or coker distillate, optionally subjecting such distillate to an aromatics removal step using an aromatics selective solvent such as phenol, furfural, NMP, etc. The distillate is then subjected to hydroconversion in at least one hydroconversion zone, more typically two zones whereas the distillate is exposed to a catalyst in the presence of hydrogen at high temperature and pressure to effect the saturation of aromatics, open rings and reduce sulfur and nitrogen content.

If the previously recited, optional aromatics removal step was not produced, the stream from the hydroconversion stage(s) can now be subject to an aromatics removal step such as solvent extraction employ a selective solvent such as phenol, furfural, NMP, etc. This stream can then be subjected to wax removal employing solvent dewaxing or catalytic dewaxing or isomerization. The stream, either before or after such dewaxing can also be subjected to hydro-finishing to further reduce the sulfur and nitrogen content.

Examples of suitable hydrocracking processes can be found in "All Hydroprocessing Route for High Viscosity Index Lubes" Zakarian et al Energy Progress, Vol. 7, No. 1, pp. 59–64; "Hydrotreated Lube Oil Base Stocks" Cashmore et al, SAE Paper 821235; "Lube Facility Makes High Quality Lube Oil from Low Quality Feed" Farrell et al, Oil and Gas Journal May 19, 1986, Technology, pp. 47–51; U.S. Pat. No. 5,976,353.

The first hydrocracked stock employed is one or more stocks having a kinematic viscosity of about 3.5 to about 6.5

$mm^2/s$ at 100° C., preferably about 3.8 to about 5 $mm^2/s$ at 100° C., more preferably about 4.2 to about 4.8 $mm^2/s$ at 100° C., a viscosity index in the range of about 100 to about 120, preferably about 105 to about 120, more preferably about 110 to about 120, a pour point of about −12° C., preferably about −15° C., more preferably about −18° C., an aniline point of about 100 to about 120° C., preferably about 105 to about 115° C., and a saturates content of about 92 to about 99 mass %, preferably about 93 to about 99 mass %, more preferably about 94 to about 96 mass %.

The second hydrocracked stock employed is one or more stocks having a kinematic viscosity of about 1.5 to about 3.5 $mm^2/s$ at 100° C., preferably about 2.0 to about 3.0 $mm^2/s$ at 100° C., a viscosity index of about 90 or higher, preferably about 90 to about 105, a pour point of about −30° C. maximum, an aniline point of about 95 to about 110° C., and a saturates content of about 90 to about 99 mass %, preferably about 95 mass % or higher, most preferably about 97 mass % or higher.

The first hydrocracked base stock is used in an amount in the range of about 60 to about 90 vol %/o, preferably about 65 to about 90 vol % and the second hydrocracked base stock is used in an amount in the range of about 10 to about 40 vol %, preferably about 10 to about 35 vol % based on the hydrocracked oil, provided that, if a solvent neutral base stock is present, the amount of such solvent neutral stock is in the range of from zero to about 45 vol %, preferably zero to about 30 vol %, more preferably zero to about 20 vol %, still more preferably zero to about 10 vol % of the total base oil mixture. The solvent neutral stock can be one or more conventional solvent neutral base oil(s) characterized by having a kinematic viscosity for about 2.5 to about 5.5 $mm^2/s$ at 100° C., a viscosity index of about 90 to about 105, a pour point of about −12° C. maximum, an aniline point of about 95° C. to about 105° C. and a saturates content of about 75 to about 85 mass %.

The base oils are combined to produce a base oil mixture/blend characterized by having a kinematic viscosity of about 3.7 to about 5 $mm^2/s$ at 100° C., preferably at least 3.9 to about 4.5 $mm^2/s$ at 100° C., a viscosity index of about 100 to about 115, and a pour point of about −24° C. maximum. A blend of base oils is employed so as to insure that the base oil kinematic viscosity target is consistently met.

The finished functional fluid will contain a performance additive package. Such performance additives will be used in an amount of about 18 to about 22 vol %, preferably about 19 to about 21 vol % of the total formulated oil and will include viscosity index improvers, anti wear additives, anti-rust additives, metal deactivators (particularly copper deactivators), anti-oxidants, friction modifiers, antifoam additives, dyes, seal swell modification additives, dispersants, pour point depressants, etc., wherein the maximum amount of diluent oil in the total additive package is between zero to about 40 vol %.

The final additized functional fluid is characterized as having a kinematic viscosity of about 6.8 to about 8.0 $mm^2/s$ at 100° C., a viscosity index of about 150 to about 200, a pour point of less than about −42° C. maximum and a Brookfield viscosity about 15,000 cP or less at −40° C., preferably about 14,600 cP or less at −40° C.

It was found that only certain combinations and concentrations of the one or more first hydrocracked base stock(s) with the one or more second hydrocracked base stock(s), with or without the optional conventional solvent neutral base stock(s) are capable of producing a functional fluid meeting the low temperature Brookfield viscosity target values and that meeting the Brookfield viscosity of the finished fluid depends on the second hydrocracked stock having the minimum viscosity index recited above.

The invention will be further explained by and understood by reference to the following non-limiting examples.

In the following Examples and Comparative Examples all of the functional fluids were formulated to meet a target base oil viscosity of 4.0 $mm^2/s$ at 100° C. and a formulated fluid viscosity of 7.0−−7.5 $mm^2/s$ at 100° C., unless otherwise indicated or unless it was not possible to meet the target. The additive package components were kept constant in all examples and the package was used in the amounts indicated.

COMPARATIVE EXAMPLE 1

The data presented in Table 1 shows the effect of using various combinations of conventional solvent neutral base stocks with or without 10 vol % of various hydrocracked oils meeting the description of the first Hydrocracked Stock. In all instances the Brookfield viscosity was well above the 15,000 cP at −40° C. maximum.

TABLE 1

| | Base Stock | KV, cSt 100° C. | VI | Pour, ° C. | Aniline, ° C. | Sats, wt % |
|---|---|---|---|---|---|---|
| Conventional Solvent Neutral | CSN 1 | 4.007 | 100 | −15 | 95 | 75 |
| | CSN 2 | 3.136 | 101 | −18 | 98 | 83 |
| | CSN 3 | 5.142 | 97 | −18 | 102 | 79 |
| | CSN 4 | 4.384 | 98 | −27 | 98 | 75 |
| Hydrocracked #1 | HC #1−1 | 4.209 | 126 | −12 | 116 | 99 |
| | HC #1−2 | 4.151 | 102 | −15 | 108 | 96 |
| | HC #1−3 | 3.870 | 105 | −18 | 101 | 92 |
| | HC #1−4 | 5.453 | 117 | −18 | 115 | 98 |
| | HC #1−5 | 4.661 | 118 | −18 | 110 | 95 |
| | HC #1−6 | 4.616 | 116 | −18 | 110 | 95 |
| | HC #1−7 | 4.500 | 117 | −21 | 110 | 95 |
| | HC #1−8 | 4.308 | 116 | −21 | 102 | 97 |
| Hydrocracked #2 | HC #2−1 | 2.464 | 97 | −36 | 103 | 98 |
| | HC #2−2 | 2.470 | 102 | −39 | 103 | 98 |
| Hydrocracked #3 | HC #3−1 | 2.954 | 75 | −39 | 96 | 99 |
| Conventional Low Pour | CLP 1 | 2.172 | 78 | −48 | 85 | 66 |
| | CLP 2 | 2.962 | 52 | −51 | 84 | 85 |
| | CLP 3 | 2.150 | 61 | −54 | 75 | 84 |
| Total Base Stocks, vol % | | | | | | |
| Additives, vol % of fluid | | | | | | |

TABLE 1-continued

| | Targets |
|---|---|
| Viscosity (Base Oil), @ 100° C. | 3.9 min |
| Viscosity (Fluid), @ 100° C. | 7.0–7.5 |
| Brookfield (Fluid), @ −40° C. | 15,000 max |

| | Base Stock | Run A | Run B | Run C | Run D | Run E | Run F |
|---|---|---|---|---|---|---|---|
| Conventional Solvent Neutral | CSN 1 | 100.0 | 53.0 | 67.9 | 71.2 | 64.8 | 66.5 |
| | CSN 2 | | | 22.1 | 18.8 | 25.2 | 23.5 |
| | CSN 3 | | 47.0 | | | | |
| | CSN 4 | | | | | | |
| Hydrocracked #1 | HC #1–1 | | | | | | |
| | HC #1–2 | | | 10.0 | | | |
| | HC #1–3 | | | | 10.0 | | |
| | HC #1–4 | | | | | | |
| | HC #1–5 | | | | | | |
| | HC #1–6 | | | | | | |
| | HC #1–7 | | | | | 10.0 | |
| | HC #1–8 | | | | | | 10.0 |
| Hydrocracked #2 | HC #2–1 | | | | | | |
| | HC #2–2 | | | | | | |
| Hydrocracked #3 | HC #3–1 | | | | | | |
| Conventional Low Pour | CLP 1 | | | | | | |
| | CLP 2 | | | | | | |
| | CLP 3 | | | | | | |
| Total Base Stocks, vol % | | 100.0 | 100.0 | 100.0 | 100.0 | 100.0 | 100.0 |
| Additives, vol % of fluid | | 20.4 | 20.4 | 20.4 | 20.4 | 20.4 | 20.4 |
| | Targets | | | | | | |
| Viscosity (Base Oil), @ 100° C. | 3.9 min | 4.00 | 4.50 | 3.80 | 3.80 | 3.80 | 3.80 |
| Viscosity (Fluid), @ 100° C. | 7.0 −7.5 | 7.426 | 8.121 | 7.090 | 7.077 | 7.073 | 7.087 |
| Brookfield (Fluid), @ −40° C. | 15,000 max | 25,550 | 37,890 | 22,180 | 20,960 | 19,380 | 18,690 |

COMPARATIVE EXAMPLE 2

The data on Table 2 shows the effect of utilizing smaller quantities of various conventional solvent neutral base stocks with hydrocracked stocks meeting the definition of the first Hydrocracked Stock. Also shown is the effect of using combinations of hydrocracked stocks meeting the definition of the first Hydrocracked Stock or using exclusively single examples of hydrocracked stocks meeting the definition of the first Hydrocracked Stock or the second Hydrocracked Stock. In the case of the mixtures, in all instances the Brookfield viscosity of the formulated fluid exceeded the 15,000 cP at −40° C. maximum.

In the case of the single stocks, while Brookfield viscosity of 15,000 cP or less at −40° C. could be reached, the base oil viscosity did not meet the target or both the base oil and fluid viscosities did not meet the targets.

TABLE 2

| | Base Stock | KV, cSt 100° C. | VI | Pour, ° C. | Aniline, ° C. | Sats. wt % |
|---|---|---|---|---|---|---|
| Conventional Solvent Neutral | CSN 1 | 4.007 | 100 | −15 | 95 | 75 |
| | CSN 2 | 3.136 | 101 | −18 | 98 | 83 |
| | CSN 3 | 5.142 | 97 | −18 | 102 | 79 |
| | CSN 4 | 4.384 | 98 | −27 | 98 | 75 |
| Hydrocracked #1 | HC #1–1 | 4.209 | 126 | −12 | 116 | 99 |
| | HC #1–2 | 4.151 | 102 | −15 | 108 | 96 |
| | HC #1–3 | 3.870 | 105 | −18 | 101 | 92 |
| | HC #1–4 | 5.453 | 117 | −18 | 115 | 98 |
| | HC #1–5 | 4.661 | 118 | −18 | 110 | 95 |
| | HC #1–6 | 4.616 | 116 | −18 | 110 | 95 |
| | HC #1–7 | 4.500 | 117 | −21 | 110 | 95 |
| | HC #1–8 | 4.308 | 116 | −21 | 102 | 97 |
| Hydrocracked #2 | HC #2–1 | 2.464 | 97 | −36 | 103 | 98 |
| | HC #2–2 | 2.470 | 102 | −39 | 103 | 98 |
| Hydrocracked #3 | HC #3–1 | 2.954 | 75 | −39 | 96 | 99 |
| Conventional Low Pour | CLP 1 | 2.172 | 78 | −48 | 85 | 66 |
| | CLP 2 | 2.962 | 52 | −51 | 84 | 85 |
| | CLP 3 | 2.150 | 61 | −54 | 75 | 84 |
| Total Base Stocks, vol % | | | | | | |
| Additives, vol % of fluid | | | | | | |
| | Targets | | | | | |
| Viscosity (Base Oil), @ 100° C. | 3.9 min | | | | | |
| Viscosity (Fluid), @ 100° C. | 7.0–7.5 | | | | | |
| Brookfield (Fluid), @ −40° C. | 15,000 max | | | | | |

TABLE 2-continued

| | Base Stock | Run A | Run B | Run C | Run D | Run E | Run F |
|---|---|---|---|---|---|---|---|
| Conventional Solvent Neutral | CSN 1 | 50.0 | | | | | |
| | CSN 2 | | 30.5 | | | | |
| | CSN 3 | | | | | | |
| | CSN 4 | | | | | | |
| Hydrocracked #1 | HC #1–1 | | | | | | |
| | HC #1–2 | | | | | | |
| | HC #1–3 | 38.0 | | 76.0 | | 100.0 | |
| | HC #1–4 | | | | | | |
| | HC #1–5 | | | | | | |
| | HC #1–6 | | | | | | |
| | HC #1–7 | 12.0 | 69.5 | 24.0 | 100.0 | | |
| | HC #1–8 | | | | | | |
| Hydrocracked #2 | HC #2–1 | | | | | | 100.0 |
| | HC #2–2 | | | | | | |
| Hydrocracked #3 | HC #3–1 | | | | | | |
| Conventional Low Pour | CLP 1 | | | | | | |
| | CLP 2 | | | | | | |
| | CLP 3 | | | | | | |
| Total Base Stocks, vol % | | 100.0 | 100.0 | 100.0 | 100.0 | 100.0 | 100.0 |
| Additives, vol % of fluid | | 20.4 | 20.4 | 20.4 | 20.4 | 20.2 | 19.8 |
| | Targets | | | | | | |
| Viscosity (Base Oil), @ 100° C. | 3.9 min | 40.0 | 40.0 | 40.0 | 4.50 | 3.87 | 2.46 |
| Viscosity (Fluid), @ 100° C. | 7.0–7.5 | 7.381 | 7.319 | 7.341 | 7.177 | 7.143 | 4.971 |
| Brookfield (Fluid), @ −40° C. | 15,000 max | 20,160 | 20,950 | 18,220 | 24,800 | 14,980 | 12,760 |

COMPARATIVE EXAMPLE 3

The data presented in Table 3 shows the effect of using various conventional solvent neutral base stocks with 10 vol % of various hydrocracked stocks meeting the definition of the first Hydrocracked Stock(s), with various conventional low pour base stocks. In all instances the Brookfield viscosity of the formulated oil was substantially greater than the target value of 15,000 cP at −40° C. maximum, even when the base oil blend viscosity was at or below the maximum/optimum viscosity and despite the use of significant amounts of exceptionally low pour point base stocks.

TABLE 3

| | Base Stock | KV, cSt 100° C. | VI | Pour, ° C. | Aniline, ° C. | Sats, wt % |
|---|---|---|---|---|---|---|
| Conventional Solvent Neutral | CSN 1 | 4.007 | 100 | −15 | 95 | 75 |
| | CSN 2 | 3.136 | 101 | −18 | 98 | 83 |
| | CSN 3 | 5.142 | 97 | −18 | 102 | 79 |
| | CSN 4 | 4.384 | 98 | −27 | 98 | 75 |
| Hydrocracked #1 | HC #1–1 | 4.209 | 126 | −12 | 116 | 99 |
| | HC #1–2 | 4.151 | 102 | −15 | 108 | 96 |
| | HC #1–3 | 3.870 | 105 | −18 | 101 | 92 |
| | HC #1–4 | 5.453 | 117 | −18 | 115 | 98 |
| | HC #1–5 | 4.661 | 118 | −18 | 110 | 95 |
| | HC #1–6 | 4.616 | 116 | −18 | 110 | 95 |
| | HC #1–7 | 4.500 | 117 | −21 | 110 | 95 |
| | HC #1–8 | 4.308 | 116 | −21 | 102 | 97 |
| Hydrocracked #2 | HC #2–1 | 2.464 | 97 | −36 | 103 | 98 |
| | HC #2–2 | 2.470 | 102 | −39 | 103 | 98 |
| Hydrocracked #3 | HC #3–1 | 2.954 | 75 | −39 | 96 | 99 |
| Conventional Low Pour | CLP 1 | 2.172 | 78 | −48 | 85 | 66 |
| | CLP 2 | 2.962 | 52 | −51 | 84 | 85 |
| | CLP 3 | 2.150 | 61 | −54 | 75 | 84 |
| Total Base Stocks, vol % | | | | | | |
| Additives, vol % of fluid | | | | | | |
| | Targets | | | | | |
| Viscosity (Base Oil), @ 100° C. | 3.9 min | | | | | |
| Viscosity (Fluid), @ 100° C. | 7.0–7.5 | | | | | |
| Brookfield (Fluid), @ −40° C. | 15,000 max | | | | | |

| | Base Stock | Run A | Run B | Run C | Run D | Run E |
|---|---|---|---|---|---|---|
| Conventional Solvent Neutral | CSN 1 | 72.3 | 82.0 | | | |
| | CSN 2 | | | | | |
| | CSN 3 | | | | | |
| | CSN 4 | | | 75.9 | 72.5 | 69.0 |

TABLE 3-continued

| | | | | | | |
|---|---|---|---|---|---|---|
| Hydrocracked #1 | HC #1–1 | | | 10.0 | 10.0 | 10.0 |
| | HC #1–2 | 10.0 | 10.0 | | | |
| | HC #1–3 | | | | | |
| | HC #1–4 | | | | | |
| | HC #1–5 | | | | | |
| | HC #1–6 | | | | | |
| | HC #1–7 | | | | | |
| | HC #1–8 | | | | | |
| Hydrocracked #2 | HC #2–1 | | | | | |
| | HC #2–2 | | | | | |
| Hydrocracked #3 | HC #3–1 | | | | | |
| Conventional Low Pour | CLP 1 | | | 14.1 | 17.5 | 21.0 |
| | CLP 2 | 17.7 | | | | |
| | CLP 3 | | 8.0 | | | |
| Total Base Stocks, vol % | | 100.0 | 100.0 | 100.0 | 100.0 | 100.0 |
| Additives, vol % of fluid | | 20.5 | 20.5 | 20.4 | 20.4 | 20.4 |
| | Targets | | | | | |
| Viscosity (Base Oil), @ 100° C. | 3.9 min | 3.80 | 3.80 | 3.90 | 3.80 | 3.70 |
| Viscosity (Fluid), @ 100° C. | 7.0–7.5 | 7.179 | 7.210 | 7.493 | 7.361 | 7.294 |
| Brookfield (Fluid), @ −40° C. | 15,000 max | 22,580 | 21,430 | 18,870 | 18,490 | 16,200 |

COMPARATIVE EXAMPLE 4

The data in Table 4 show the effect of using large quantities (70 vol % or more) of various conventional solvent neutral base stocks with 10 vol % of various hydrocracked stocks meeting the definition of the first Hydrocracked Stock with two different additional hydrocracked stocks. Again, the Brookfield Viscosity of the formulated oils substantially exceeded the target of about 15,000 cP at −40° C. maximum.

TABLE 4

| | Base Stock | KV, cSt 100° C. | VI | Pour, ° C. | Aniline, ° C. | Sats, wt % |
|---|---|---|---|---|---|---|
| Conventional Solvent Neutral | CSN 1 | 4.007 | 100 | −15 | 95 | 75 |
| | CSN 2 | 3.136 | 101 | −18 | 98 | 83 |
| | CSN 3 | 5.142 | 97 | −18 | 102 | 79 |
| | CSN 4 | 4.384 | 98 | −27 | 98 | 75 |
| Hydrocracked #1 | HC #1–1 | 4.209 | 126 | −12 | 116 | 99 |
| | HC #1–2 | 4.151 | 102 | −15 | 108 | 96 |
| | HC #1–3 | 3.870 | 105 | −18 | 101 | 92 |
| | HC #1–4 | 5.453 | 117 | −18 | 115 | 98 |
| | HC #1–5 | 4.661 | 118 | −18 | 110 | 95 |
| | HC #1–6 | 4.616 | 116 | −18 | 110 | 95 |
| | HC #1–7 | 4.500 | 117 | −21 | 110 | 95 |
| | HC #1–8 | 4.308 | 116 | −21 | 102 | 97 |
| Hydrocracked #2 | HC #2–1 | 2.464 | 97 | −36 | 103 | 98 |
| | HC #2–2 | 2.470 | 102 | −39 | 103 | 98 |
| Hydrocracked #3 | HC #3–1 | 2.954 | 75 | −39 | 96 | 99 |
| Conventional Low Pour | CLP 1 | 2.172 | 78 | −48 | 85 | 66 |
| | CLP 2 | 2.962 | 52 | −51 | 84 | 85 |
| | CLP 3 | 2.150 | 61 | −54 | 75 | 84 |
| Total Base Stocks, vol % | | | | | | |
| Additives, vol % of fluid | | | | | | |
| | Targets | | | | | |
| Viscosity (Base Oil), @ 100° C. | 3.9 min | | | | | |
| Viscosity (Fluid), @ 100° C. | 7.0–7.5 | | | | | |
| Brookfield (Fluid), @ −40° C. | 15,000 max | | | | | |

| | Base Stock | Run A | Run B | Run C | Run D | Run E | Run F |
|---|---|---|---|---|---|---|---|
| Conventional Solvent Neutral | CSN 1 | 71.0 | 60.0 | 48.0 | 62.0 | 46.5 | 30.5 |
| | CSN 2 | | | | | | |
| | CSN 3 | 9.0 | 15.0 | 22.0 | 18.0 | 28.5 | 39.5 |
| | CSN 4 | | | | | | |
| Hydrocracked #1 | HC #1–1 | | | | | | |
| | HC #1–2 | | | | | | |
| | HC #1–3 | | | | | | |
| | HC #1–4 | | | | | | |
| | HC #1–5 | | | | | | |
| | HC #1–6 | | | | | | |
| | HC #1–7 | 10.0 | 10.0 | 10.0 | 10.0 | 10.0 | 10.0 |
| | HC #1–8 | | | | | | |
| Hydrocracked #2 | HC #2–1 | | | | 10.0 | 15.0 | 20.0 |
| | HC #2–2 | | | | | | |
| Hydrocracked #3 | HC #3–1 | 10.0 | 15.0 | 20.0 | | | |

TABLE 4-continued

| | | | | | | | |
|---|---|---|---|---|---|---|---|
| Conventional Low Pour | CLP 1 | | | | | | |
| | CLP 2 | | | | | | |
| | CLP 3 | | | | | | |
| Total Base Stocks, vol % | | 100.0 | 100.0 | 100.0 | 100.0 | 100.0 | 100.0 |
| Additives, vol % of fluid | | 20.4 | 20.4 | 20.4 | 20.4 | 20.4 | 20.4 |
| | Targets | | | | | | |
| Viscosity (Base Oil), @ 100° C. | 3.9 min | 40.0 | 40.0 | 40.0 | 40.0 | 40.0 | 40.0 |
| Viscosity (Fluid), @ 100° C. | 7.0–7.5 | 7.431 | 7.437 | 7.451 | 7.400 | 7.388 | 7.399 |
| Brookfield (Fluid), @ −40° C. | 15,000 max | 24,450 | 23,900 | 20,950 | 20,150 | 20,050 | 20,050 |

COMPARATIVE EXAMPLE 5

The data in Table 5 show the effect of using varying amount of conventional solvent neutral base stock in combination with varying amounts of hydrocracked stocks meeting the definition of the first Hydrocracked Stock but including an additional quantity of another hydrocracked stock which meets the definition of the second Hydrocracked Stock with regards to pour point, aniline point, saturates content, and kinematic viscosity, but which does not meet the definition of the second Hydrocracked Stock with regard to VI (herein referred to as Hydrocracked #3).

TABLE 5

| | Base Stock | KV, cSt 100° C. | VI | Pour, ° C. | Aniline, ° C. | Sats, wt % |
|---|---|---|---|---|---|---|
| Conventional Solvent Neutral | CSN 1 | 4.007 | 100 | −15 | 95 | 75 |
| | CSN 2 | 3.136 | 101 | −18 | 98 | 83 |
| | CSN 3 | 5.142 | 97 | −18 | 102 | 79 |
| | CSN 4 | 4.384 | 98 | −27 | 98 | 75 |
| Hydrocracked #1 | HC #1–1 | 4.209 | 126 | −12 | 116 | 99 |
| | HC #1–2 | 4.151 | 102 | −15 | 108 | 96 |
| | HC #1–3 | 3.870 | 105 | −18 | 101 | 92 |
| | HC #1–4 | 5.453 | 117 | −18 | 115 | 98 |
| | HC #1–5 | 4.661 | 118 | −18 | 110 | 95 |
| | HC #1–6 | 4.616 | 116 | −18 | 110 | 95 |
| | HC #1–7 | 4.500 | 117 | −21 | 110 | 95 |
| | HC #1–8 | 4.308 | 116 | −21 | 102 | 97 |
| Hydrocracked #2 | HC #2–1 | 2.464 | 97 | −36 | 103 | 98 |
| | HC #2–2 | 2.470 | 102 | −39 | 103 | 98 |
| Hydrocracked #3 | HC #3–1 | 2.954 | 75 | −39 | 96 | 99 |
| Conventional Low Pour | CLP 1 | 2.172 | 78 | −48 | 85 | 66 |
| | CLP 2 | 2.962 | 52 | −51 | 84 | 85 |
| | CLP 3 | 2.150 | 61 | −54 | 75 | 84 |
| Total Base Stocks, vol % | | | | | | |
| Additives, vol % of fluid | | | | | | |
| | Targets | | | | | |
| Viscosity (Base Oil), @ 100° C. | 3.9 min | | | | | |
| Viscosity (Fluid), @ 100° C. | 7.0–7.5 | | | | | |
| Brookfield (Fluid), @ −40° C. | 15,000 max | | | | | |

| | Base Stock | Run A | Run B | Run C | Run D | Run E | Run F |
|---|---|---|---|---|---|---|---|
| Conventional Solvent Neutral | CSN 1 | 72.0 | 58.0 | 47.0 | 80.0 | 33.0 | 16.0 |
| | CSN 2 | | | | | | |
| | CSN 3 | | | | | | |
| | CSN 4 | | | | | | |
| Hydrocracked #1 | HC #1–1 | | | | | | |
| | HC #1–2 | | | | | | |
| | HC #1–3 | | | | | | |
| | HC #1–4 | 15.0 | 22.0 | 28.0 | | | |
| | HC #1–5 | | | | | | |
| | HC #1–6 | | | | | 47.0 | 59.0 |
| | HC #1–7 | | | | 15.0 | | |
| | HC #1–8 | | | | | | |
| Hydrocracked #2 | HC #2–1 | | | | | | |
| | HC #2–2 | | | | | | |
| Hydrocracked #3 | HC #3–1 | 13.0 | 20.0 | 25.0 | 5.0 | 20.0 | 25.0 |
| Conventional Low Pour | CLP 1 | | | | | | |
| | CLP 2 | | | | | | |
| | CLP 3 | | | | | | |
| Total Base Stocks, vol % | | 100.0 | 100.0 | 100.0 | 100.0 | 100.0 | 100.0 |
| Additives, vol % of fluid | | 20.4 | 20.4 | 20.4 | 20.4 | 20.4 | 20.4 |

TABLE 5-continued

| | Targets | | | | | | |
|---|---|---|---|---|---|---|---|
| Viscosity (Base Oil), @ 100° C. | 3.9 min | 4.00 | 4.00 | 4.00 | 4.00 | 4.00 | 4.00 |
| Viscosity (Fluid), @ 100° C. | 7.0–7.5 | 7.435 | 7.445 | 7.443 | 7.437 | 7.377 | 7.357 |
| Brookfield (Fluid), @ −40° C. | 15,000 max | 21,600 | 20,900 | 19,820 | 19,350 | 19,080 | 17,240 |

In all instances the Brookfield Viscosity of the formulated oil exceeded the target of about 15,000 cP at −40° C. maximum. This is true even when using high amounts of each of the hydrocracked stocks, and even though the additional hydrocracked stock (Hydrocracked #3) had a pour point of −39° C.

COMPARATIVE EXAMPLE 6

The data in Table 6 shows the effect of using conventional solvent neutral stocks (at high concentration) with 15 vol % of various hydrocracked stocks meeting the definition of the first Hydrocracked Stock and small amount of an additional hydrocracked stock meeting the definition of the second Hydrocracked Stock. The Brookfield viscosity substantially exceeded the target of about 15,000 cP at −40° C. maximum.

TABLE 6

| | Base Stock | KV, cSt 100° C. | VI | Pour, ° C. | Aniline, ° C. | Sats, wt % |
|---|---|---|---|---|---|---|
| Conventional Solvent Neutral | CSN 1 | 4.007 | 100 | −15 | 95 | 75 |
| | CSN 2 | 3.136 | 101 | −18 | 98 | 83 |
| | CSN 3 | 5.142 | 97 | −18 | 102 | 79 |
| | CSN 4 | 4.384 | 98 | −27 | 98 | 75 |
| Hydrocracked #1 | HC #1–1 | 4.209 | 126 | −12 | 116 | 99 |
| | HC #1–2 | 4.151 | 102 | −15 | 108 | 96 |
| | HC #1–3 | 3.870 | 105 | −18 | 101 | 92 |
| | HC #1–4 | 5.453 | 117 | −18 | 115 | 98 |
| | HC #1–5 | 4.661 | 118 | −18 | 110 | 95 |
| | HC #1–6 | 4.616 | 116 | −18 | 110 | 95 |
| | HC #1–7 | 4.500 | 117 | −21 | 110 | 95 |
| | HC #1–8 | 4.308 | 116 | −21 | 102 | 97 |
| Hydrocracked #2 | HC #2–1 | 2.464 | 97 | −36 | 103 | 98 |
| | HC #2–2 | 2.470 | 102 | −39 | 103 | 98 |
| Hydrocracked #3 | HC #3–1 | 2.954 | 75 | −39 | 96 | 99 |
| Conventional Low Pour | CLP 1 | 2.172 | 78 | −48 | 85 | 66 |
| | CLP 2 | 2.962 | 52 | −51 | 84 | 85 |
| | CLP 3 | 2.150 | 61 | −54 | 75 | 84 |
| Total Base Stocks, vol % | | | | | | |
| Additives, vol % of fluid | | | | | | |
| | Targets | | | | | |
| Viscosity (Base Oil), @ 100° C. | 3.9 min | | | | | |
| Viscosity (Fluid), @ 100° C. | 7.0–7.5 | | | | | |
| Brookfield (Fluid), @ −40° C. | 15,000 max | | | | | |

| | Base Stock | Run A | Run B | Run C | Run D | Run E | Run F |
|---|---|---|---|---|---|---|---|
| Conventional Solvent Neutral | CSN 1 | 81.0 | 81.0 | 82.0 | 77.0 | 82.0 | 82.0 |
| | CSN 2 | | | | | | |
| | CSN 3 | | | | | | |
| | CSN 4 | | | | | | |
| Hydrocracked #1 | HC #1–1 | | | | | | |
| | HC #1–2 | | | | | | |
| | HC #1–3 | | | | | | |
| | HC #1–4 | | | | 15.0 | | |
| | HC #1–5 | 15.0 | | 15.0 | | | |
| | HC #1–6 | | 15.0 | | | 15.0 | |
| | HC #1–7 | | | | | | 15.0 |
| | HC #1–8 | | | | | | |
| Hydrocracked #2 | HC #2–1 | 4.0 | 4.0 | 3.0 | 8.0 | 3.0 | 3.0 |
| | HC #2–2 | | | | | | |
| Hydrocracked #3 | HC #3–1 | | | | | | |
| Conventional Low Pour | CLP 1 | | | | | | |
| | CLP 2 | | | | | | |
| | CLP 3 | | | | | | |
| Total Base Stocks, vol % | | 100.0 | 100.0 | 100.0 | 100.0 | 100.0 | 100.0 |
| Additives, vol % of fluid | | 20.4 | 20.4 | 20.4 | 20.4 | 20.4 | 20.4 |
| | Targets | | | | | | |
| Viscosity (Base Oil), @ 100° C. | 3.9 min | 4.00 | 4.00 | 4.02 | 4.00 | 4.02 | 4.00 |
| Viscosity (Fluid), @ 100° C. | 7.0–7.5 | 7.405 | 7.380 | 7.444 | 7.407 | 7.421 | 7.428 |
| Brookfield (Fluid), @ −40° C. | 15,000 max | 21,650 | 21,550 | 20,600 | 20,450 | 19,300 | 19,250 |

EXAMPLE 1

The data in Table 7 show the result of using higher amounts of hydrocracked stock meeting the definition of the first Hydrocracked Stock with greater amount of the second Hydrocracked Stock (as compared with the concentration used in Comparative Example 6) both with and without the use of minor amounts of conventional solvent neutral oil.

From this it is seen that the VI of the second hydrocracked stock plays an important and unexpected role in enabling the formulation to meet the Brookfield viscosity target.

Comparing the data in Table 7 with that in Table 2 it is also seen that it is important to employ a mixture of hydrocracked stocks in order to consistently meet the base oil kinematic viscosity target.

TABLE 7

| | Base Stock | KV, cSt 100° C. | VI | Pour, ° C. | Aniline, ° C. | Sats, wt % |
|---|---|---|---|---|---|---|
| Conventional Solvent Neutral | CSN 1 | 4.007 | 100 | −15 | 95 | 75 |
| | CSN 2 | 3.136 | 101 | −18 | 98 | 83 |
| | CSN 3 | 5.142 | 97 | −18 | 102 | 79 |
| | CSN 4 | 4.384 | 98 | −27 | 98 | 75 |
| Hydrocracked #1 | HC #1–1 | 4.209 | 126 | −12 | 116 | 99 |
| | HC #1–2 | 4.151 | 102 | −15 | 108 | 96 |
| | HC #1–3 | 3.870 | 105 | −18 | 101 | 92 |
| | HC #1–4 | 5.453 | 117 | −18 | 115 | 98 |
| | HC #1–5 | 4.661 | 118 | −18 | 110 | 95 |
| | HC #1–6 | 4.616 | 116 | −18 | 110 | 95 |
| | HC #1–7 | 4.500 | 117 | −21 | 110 | 95 |
| | HC #1–8 | 4.308 | 116 | −21 | 102 | 97 |
| Hydrocracked #2 | HC #2–1 | 2.464 | 97 | −36 | 103 | 98 |
| | HC #2–2 | 2.470 | 102 | −39 | 103 | 98 |
| Hydrocracked #3 | HC #3–1 | 2.954 | 75 | −39 | 96 | 99 |
| Conventional Low Pour | CLP 1 | 2.172 | 78 | −48 | 85 | 66 |
| | CLP 2 | 2.962 | 52 | −51 | 84 | 85 |
| | CLP 3 | 2.150 | 61 | −54 | 75 | 84 |
| Total Base Stocks, vol % | | | | | | |
| Additives, vol % of fluid | | | | | | |
| | Targets | | | | | |
| Viscosity (Base Oil), @ 100° C. | 3.9 min | | | | | |
| Viscosity (Fluid), @ 100° C. | 7.0–7.5 | | | | | |
| Brookfield (Fluid), @ −40° C. | 15,000 max | | | | | |

| | Base Stock | Run A | Run B | Run C | Run D | Run E | Run F |
|---|---|---|---|---|---|---|---|
| Conventional Solvent Neutral | CSN 1 | 43.0 | 29.0 | 2.0 | | | |
| | CSN 2 | | | | | | |
| | CSN 3 | | | | | | |
| | CSN 4 | | | | | | |
| Hydrocracked #1 | HC #1–1 | | | | | | |
| | HC #1–2 | | | | | | |
| | HC #1–3 | | | | | | |
| | HC #1–4 | 37.0 | 46.0 | | | | |
| | HC #1–5 | | | | | | |
| | HC #1–6 | | | 78.0 | 79.5 | | |
| | HC #1–7 | | | | | 82.5 | 82.5 |
| | HC #1–8 | | | | | | |
| Hydrocracked #2 | HC #2–1 | 20.0 | 25.0 | 20.0 | | | |
| | HC #2–2 | | | | 20.5 | 17.5 | 17.5 |
| Hydrocracked #3 | HC #3–1 | | | | | | |
| Conventional Low Pour | CLP 1 | | | | | | |
| | CLP 2 | | | | | | |
| | CLP 3 | | | | | | |
| Total Base Stocks, vol % | | 100.0 | 100.0 | 100.0 | 100.0 | 100.0 | 100.0 |
| Additives, vol % of fluid | | 20.4 | 20.4 | 20.4 | 20.1 | 20.1 | 20.1 |
| | Targets | | | | | | |
| Viscosity (Base Oil), @ 100° C. | 3.9 min | 4.00 | 4.00 | 4.00 | 4.00 | 4.00 | 4.00 |
| Viscosity (Fluid), @ 100° C. | 7.0–7.5 | 7.360 | 7.318 | 7.269 | 7.170 | 7.172 | 7.185 |
| Brookfield (Fluid), @ −40° C. | 15,000 max | 15,030 | 13,400 | 13,050 | 13,720 | 14,170 | 14,580 |

In all instances the formulated oil met the target of a Brookfield viscosity of about 15,000 cP or less at −40° C.

This result is unexpected when viewed in light of the data in Table 5, Runs C, E and F wherein in said runs the base oil used was a combination of conventional solvent neutral oil, first Hydrocracked Stock and a second hydrocracked stock which corresponded in all ways except for VI to Hydrocracked Stock 2.

What is claimed is:

1. A functional fluid comprising (A) a mixture of at least two hydrocracked base stocks, said mixture comprising (i) at least one first hydrocracked base having a kinematic viscosity of about 3.5 to about 6.5 $mm^2$/sec at 100° C., a viscosity index of about 100 to about 120, a pour point of about −12° C. maximum, an aniline point of about 100 to about 120° C., a saturates content of about 92 to about 99 mass %;

(ii) at least one second hydrocracked base stock having a kinematic viscosity of about 1.5 to about 3.5 $mm^2$/sec at 100° C., a viscosity index of about 90 or higher, a pour point of about −30° C. maximum, an aniline point of about 95° C. to about 110° C., a saturates content of about 90 to about 99 mass %;

said first and second hydrocracked base stocks being mixed in an amount of about 60 to about 90 vol % of the first hydrocracked base stock (i) and about 10% to about 40% of the second hydrocracked base stock (ii), based on the hydrocracked stock;

wherein the first hydrocracked base stock (i) and second hydrocracked base stock (ii) are not the same; and (B) zero up to about 45 vol % of one or more conventional solvent neutral base stock(s), the conventional solvent neutral base stock having a kinematic viscosity of about 2.5 to about 5.5 $mm^2$/sec at 100° C., a viscosity index of about 90 to about 105, a pour point of about −12° C. maximum, an aniline point of about 95 to about 105° C., a saturates content of about 75 to about 85 mass %; wherein said mixture of base stocks has a kinematic viscosity of about 3.7 to about 5 $mm^2$/sec at 100° C., a viscosity index of about 100 to about 115, a pour point of about −24° C. maximum;

(C) an additive package, the resulting additized functional fluid having a kinematic viscosity of about 6.8 to about 8.0 $mm^2$/sec at 100° C., a viscosity index of 150 to about 200, a pour point of about <−42° C. maximum, and a Brookfield viscosity of about 15,000 cP or less at −40° C.

2. The functional fluid of claim 1 wherein base stock (i) has a kinematic viscosity of about 3.8 to about 5 $mm^2$/sec at 100° C., a viscosity index of about 105 to about 120, a pour point of about −15° C. maximum, an aniline point of about 105 to about 115° C., a saturates content of about 93 to about 99 mass %.

3. The functional fluid of claim 1 or 2 wherein base stock (ii) has a kinematic viscosity of about 2.0 to about 3.0 $mm^2$/sec at 100° C., a viscosity index of about 90 to about 105, a pour point of about −30° C. maximum, an aniline point of about 95° C. to about 110° C., a saturates content of about 95 mass % or higher.

4. The functional fluid of claim 1 wherein base stock (i) has a kinematic viscosity of about 4.2 to about 4.8 $mm^2$/sec at 100° C., a viscosity index of about 110 to about 120, a pour point of about −18° C. maximum, an aniline point of about 105° C. to about 115° C., a saturates content of about 94 to about 96 mass %.

5. The functional fluid of claim 3 wherein base stock (i) has a kinematic viscosity of about 4.2 to about 4.8 $mm^2$/sec at 100° C., a viscosity index of about 110 to about 120, a pour point of about −18° C. maximum, an aniline point of about 105 to about 115° C., a saturates content of about 94 to about 96 mass %.

6. The functional fluid of claim 3 wherein base stock (ii) has a kinematic viscosity of about 2.0 to about 3.0 $mm^2$/sec at 100° C., a viscosity index of about 95 to about 105, a pour point of about −30° C. maximum, an aniline point of about 95 to about 110° C., a saturates content of about 97 mass % or higher.

7. The functional fluid of claim 4 wherein base stock (ii) has a kinematic viscosity of about 2.0 to about 3.0 $mm^2$/sec at 100° C., a viscosity index of about 95 to about 105, a pour point of about −30° C. maximum, an aniline point of about 95 to about 110° C., a saturates content of about 97 mass % or higher.

8. The functional fluid of claim 1 wherein the solvent extracted base stock is present in the amount of zero up to about 30 vol %.

9. The functional fluid of claim 1 wherein the solvent extracted base stock is present in the amount of zero up to about 20 vol %.

* * * * *